US006761136B2

(12) United States Patent
Ohsawa

(10) Patent No.: US 6,761,136 B2
(45) Date of Patent: Jul. 13, 2004

(54) PORTABLE POWER WORKING MACHINE

(75) Inventor: Hisato Ohsawa, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/452,607

(22) Filed: Jun. 2, 2003

(65) Prior Publication Data

US 2003/0221640 A1 Dec. 4, 2003

(30) Foreign Application Priority Data

Jun. 3, 2002 (JP) ..... 2002/161732

(51) Int. Cl.[7] ..... F01P 5/06; F02B 63/02; F02M 35/08; F02M 35/10; B27B 17/00

(52) U.S. Cl. ..... 123/41.56

(58) Field of Search ..... 123/41.57–47.7

(56) References Cited

U.S. PATENT DOCUMENTS 5,231,956 A * 8/1993 Lux et al. ..... 123/41.65
5,367,988 A * 11/1994 Collins ..... 123/41.65
6,295,953 B1 10/2001 Ohsawa et al.
6,314,922 B1 * 11/2001 Zimmermann et al. .. 123/41.65
6,378,467 B1 4/2002 Kobayashi et al. ..... 123/41.56
6,523,508 B2 * 2/2003 Hüsges et al. ..... 123/41.65
6,525,430 B1 * 2/2003 Asai et al. ..... 290/1 A
6,526,924 B2 * 3/2003 Söderqvist ..... 123/41.65

* cited by examiner

*Primary Examiner*—Marguerite McMahon
(74) *Attorney, Agent, or Firm*—Baker Botts LLP

(57) ABSTRACT

A portable power working machine (10) is disclosed, which is capable of effectively improving the performance thereof to cool the internal combustion engine (20), and also capable of preventing an air cleaner (30) of the air intake system of the internal combustion engine (20) from being clogged with dust. This portable power working machine is characteristic in that it comprises a guiding wall (28) disposed on one side of a main housing (12) and at a location rear to a cooling fan (25) and projected inward therefrom for guiding cooling air toward the cylinder (21) of the internal combustion engine (20); an intake passageway (50) formed at a location rear to the cooling fan (25) for introducing air into an air-intake system (30, 34, 35) of the internal combustion engine (20); and an air-intake port (55) for the intake passageway (50), the air-intake port (55) being positioned in the vicinity of a root portion (28*a*) of the rear face of the guiding wall (28).

7 Claims, 3 Drawing Sheets

PORTABLE POWER WORKING MACHINE

BACKGROUND OF THE INVENTION

The present invention relates to a portable power working machine such as a chain saw, a power cutter, a hedge trimmer, etc., which is provided with an internal combustion engine as a driving power source for driving the working components thereof, and in particular, to a portable power working machine which is designed to prevent, in a most possible manner, an air cleaner attached to an air intake system of an internal combustion engine from being clogged with dust and to make it possible to effectively improve the performance thereof to cool the internal combustion engine.

A conventional portable power working machine, such as a chain saw, is generally constructed such that a small air-cooled internal combustion engine acting as a driving power source for driving the working components, such as a saw chain, is mounted in a main housing, that a cooling fan driven by the internal combustion engine is disposed on one side of the main housing, that the air introduced into the main housing by means of the cooling fan is forced to blow against the internal combustion engine (the cylinder portion thereof) and that external air is permitted to enter, through an air cleaner, a carburetor chamber and a carburetor, into the internal combustion engine.

One of important problems in the portable power working machine which is constructed as mentioned above is how to effectively cool the internal combustion engine by the air that has been sucked by means of the cooling fan into the main housing.

Additionally, in the operation of this portable power working machine, dust that includes sawdust of relatively large size, powder of cut material and sand-like dust is inevitably generated. When dust of those kinds is allowed to enter together with air into the air intake system of the internal combustion engine, and to collect on the filter element of the air cleaner, the clogging of the filter will be resulted, thus giving rise to an irregularity of the internal combustion engine as well as a deterioration of performance of the internal combustion engine due to an insufficiency in the flow speed of intake air. Accordingly, it is required in the operation of the portable power working machine to usually clean the air cleaner, etc., which is a task that is quite troublesome for the operator.

BRIEF SUMMARY OF THE INVENTION

The present invention has been made to solve the aforementioned problem. In particular, it is an object of the present invention to provide a portable power working machine which is capable of effectively improving the performance thereof to cool the internal combustion engine mounted thereon as a power source for driving the working components thereof, and also capable of preventing, in a most possible manner, an air cleaner of the air intake system of a small air-cooled internal combustion engine from being clogged with dust.

With a view to attaining the aforementioned objects, there is provided, in accordance with the present invention, a portable power working machine comprising: a main housing; an air-cooled internal combustion engine received in the main housing with a cylinder thereof being horizontally disposed and a head portion of the cylinder being orientated rearward; a cooling fan which is adapted to be driven by the internal combustion engine and disposed on one side of the main housing; a guiding wall disposed on one side of the main housing and at a location rear to the cooling fan and projected inward therefrom for guiding cooling air toward the cylinder; an intake passageway formed at a location rear to the cooling fan for introducing air into an air-intake system of the internal combustion engine; and an air-intake port for the intake passageway, the air-intake port being positioned in the vicinity of a root portion of the rear face of the guiding wall.

Preferably, the guiding wall is formed on a fan cover which is disposed inner than an outer cover of the main housing.

In a preferable embodiment, the intake passageway is constituted by the outer cover and the fan cover, and the air-intake port is formed in the fan cover.

Preferably, an upstream end portion of the intake passageway is positioned in the vicinity of bottom of the main housing, and the air-intake port is formed in the vicinity of the upstream end portion to communicate with the intake passageway.

In another preferable embodiment, the air entering from the air-intake port is enabled to enter into a carburetor through the intake passageway and an air cleaner.

Preferably, the air cleaner is formed of a cap-like configuration and detachably secured to a rear end portion of the main housing with a filter member being interposed therebetween as a partitioning wall, thereby enabling the air cleaner to communicate through the filter member with the carburetor.

A typical example of a portable power working machine in which the present invention is especially advantageous is a chain saw which is provided with a saw chain set composed of a saw chain and a guide bar and disposed on the other side of the main housing which is opposite to the aforementioned one side, the chain saw being known to produce large quantities of dust, including relatively large particles during the operation thereof.

According to the aforementioned preferred embodiment of the portable power working machine constructed as described above, the external air that has been introduced into the main housing by means of the cooling fan can be reliably guided toward the cylinder where cooling is most needed by the effect of the guiding wall formed on the fan cover, the air being subsequently employed for cooling the cylinder and then discharged through a discharger port formed in the main housing toward the external atmosphere. Part of the air introduced into the main housing is permitted to enter into the internal combustion engine through the intake passageway, the air cleaner, the carburetor chamber and the carburetor.

In this case, even if large quantities of dust is mixed into the air to be sucked by means of the cooling fan into the main housing, since this air mixed with dust can be concentratedly guided toward the cylinder by the effect of the guiding wall, most of the dust can be prevented from flowing down to the vicinity of the root portion of the rear face of guiding wall (a region where the fan cover is disposed). Therefore, the air that will be introduced, via the intake passageway and the air cleaner, into the carburetor after being sucked from the air-intake port positioned in the vicinity of root portion of the rear face of the guiding wall will be almost free from any dust.

Therefore, accordingly to the portable power working machine of the present invention, since it is constructed such that a guiding wall is formed to thereby enable an air-intake port to be positioned in the vicinity of root portion of the rear face of the guiding wall, the performance thereof to cool the internal combustion engine can be effectively enhanced and, the clogging of the air cleaner of the air intake system of internal combustion engine due to the dust in the sucked air can be minimized, thus making usual cleaning of the air cleaner unnecessary.

DETAILED DESCRIPTION OF THE INVENTION

One embodiment of the present invention will be explained in detail with reference to the drawings.

Figure 1:
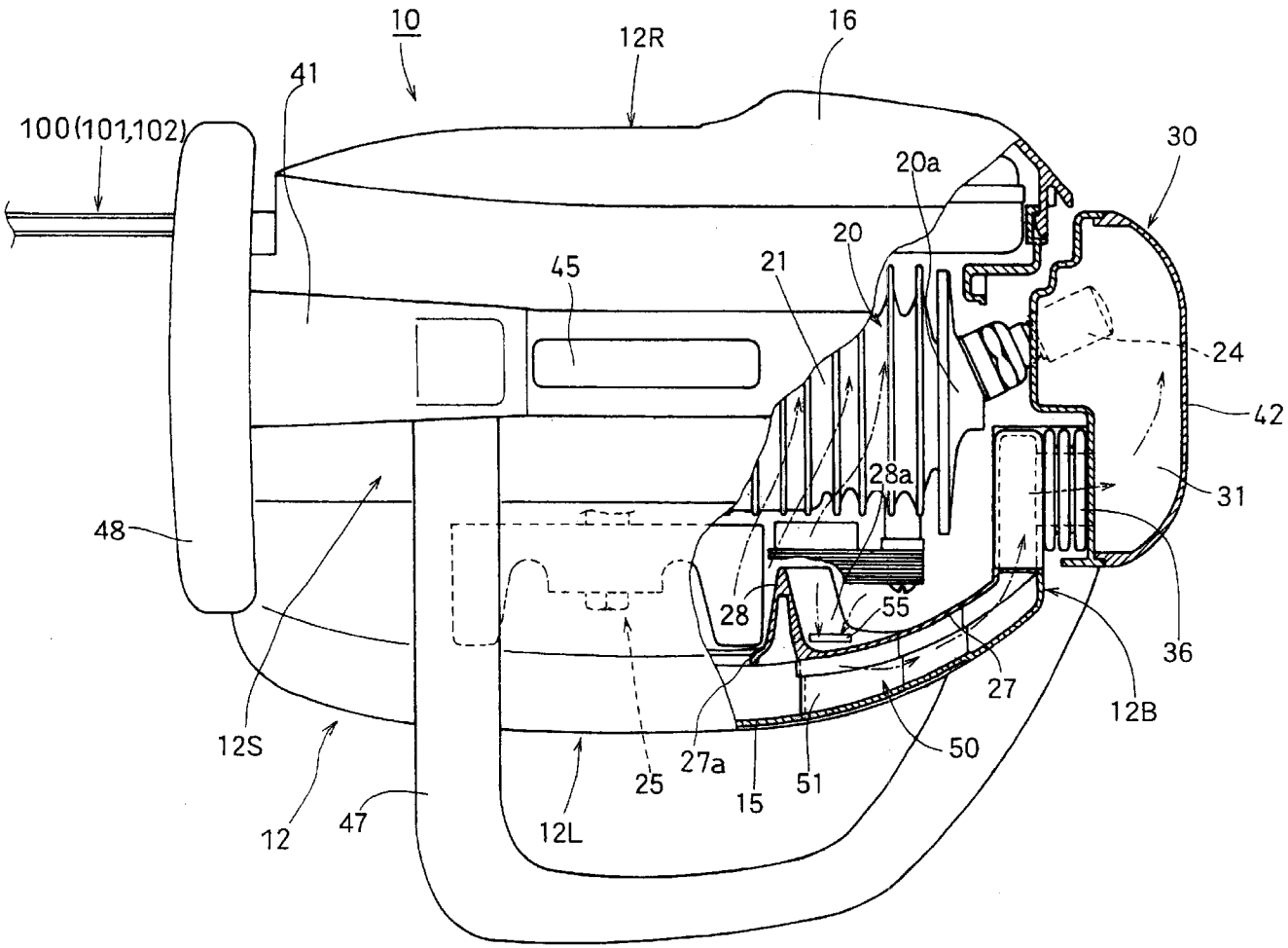
FIG. 1 is a partially cut plan view illustrating one embodiment of chain saw representing one example of the portable power working machine according to the present invention.
Figure 2:
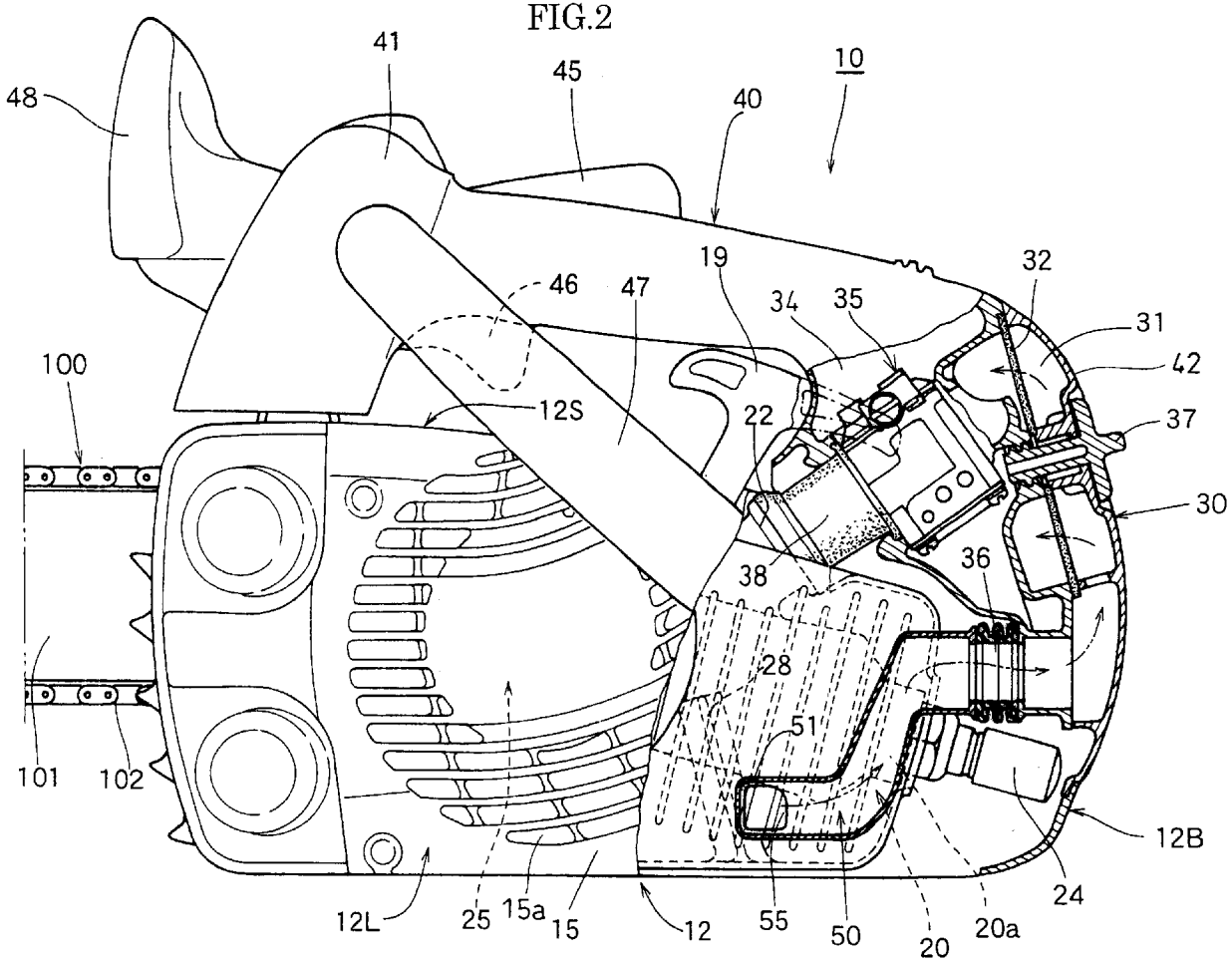
FIG. 2 is a partially cut left side view of the chain saw shown in FIG. 1.

FIGS. 1 and 2 illustrate one embodiment of chain saw representing one example of the portable power working machine according to the present invention, wherein FIG. 1 shows a partially cut plan view thereof and FIG. 2 shows a partially cut left side view thereof.

The chain saw 10 shown therein comprises a small air-cooled two-stroke cycle gasoline internal combustion engine (hereinafter referred to as an internal combustion engine) 20. This internal combustion engine 20 is mounted, through a vibro-isolating mechanism (not shown), inside the main housing 12 made of a synthetic resin in such a manner that the cylinder 21 thereof is horizontally orientated, that the air inlet port 22 thereof is orientated upward and that the head portion 20*a* thereof is orientated rearward. This internal combustion engine 20 is provided, on the head portion 20*a* thereof, with an ignition plug 24 which is extended rearward and inclined outward.

A clutch cover 16 covering a centrifugal clutch (not shown) and acting as an output member of the internal combustion engine 20 is attached to the right sidewall 12R of the main housing 12. Inside the clutch cover 16, a saw chain set 100 which is composed of a guide bar 101 and a saw chain 102 slidably trained along the guide bar 101 is mounted as a working component on the forward portion of the internal combustion engine 20, and thereby enabling the saw chain 102 to be driven by the internal combustion engine 20.

Further, in a left side 12L of the main housing 12, there are disposed a cooling fan 25 to be driven by the internal combustion engine 20, and a recoil starter case 15 acting as an outer cover having a suitable number of air-intake slits 15*a* and covering the cooling fan 25.

On the other hand, on a top surface 12S of the main housing 12, there are disposed various members including an arch-shaped top handle 40 having a throttle lock lever 45 and a throttle trigger 46 integrated therewith, a hand guard 48 which is disposed in front of this top handle 40, and an auxiliary handle 47 which is extended rearward from a fore portion of the top handle 40 and inclined downward. The rear sidewall region 42 of the top handle 40 is shaped into a box-like configuration having a wide top face, the width of which is made larger than that of other regions of the top handle 40.

The intake port 22 of the internal combustion engine 20 is communicated via a flexible connecting tube 38 with a diaphragm type carburetor 35 which is mounted inside the carburetor chamber 34 communicated with an air cleaner 30. These carburetor 35 and carburetor chamber 34 are accommodated inside the rear sidewall region 42 of the top handle 40. This air cleaner 30 is cap-like in configuration and disposed contiguous, via a filter member 32 acting also as a partitioning wall, to the carburetor chamber 34. This air cleaner 30 is detachably secured by means of a screw member 37 to a rear end portion 12B of the main housing 12.

Figure 3:
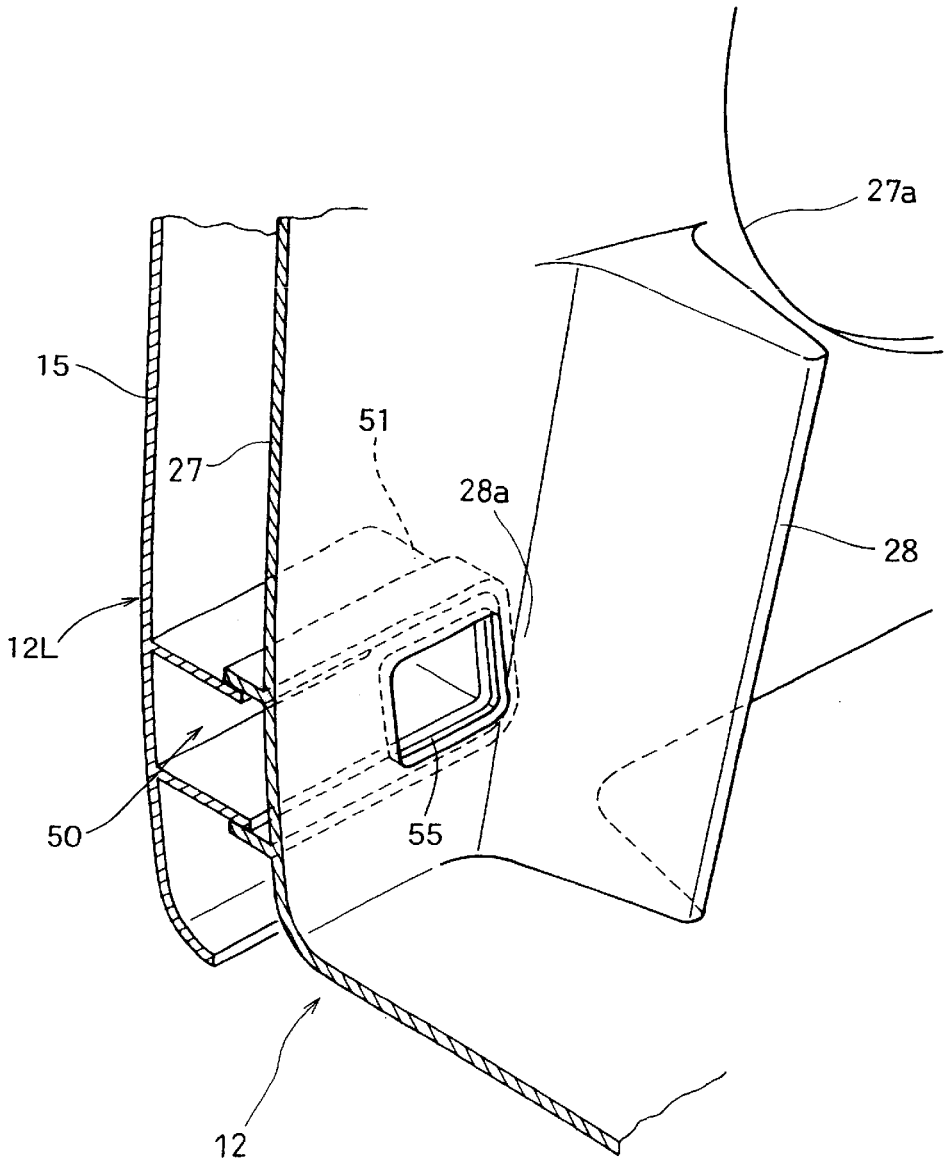
FIG. 3 is a partially cut enlarged perspective view illustrating in detail the guiding wall and the intake passageway both disposed in the chain saw shown in FIG. 1.

In this embodiment, a fan cover 27 having an air-intake port 27*a* is disposed inner than the recoil starter case 15 constituting the left side 12L of the main housing 12. Further, as will be clearly recognized from FIGS. 1, 2 and 3, a guiding wall 28 having a ridge-like cross-section is positioned at a region of the fan cover 27, is rear to the cooling fan 25, and projects inward therefrom so as to guide cooling air into the cylinder 21. In this case, an intake passageway (or air duct) 50 having a reverse-L shaped configuration in its left side view and an approximately rectangular cross-sectional configuration is defined by the recoil starter case 15 and the fan cover 27, thereby enabling air to be guided into the carburetor chamber 34. Additionally, the intake passageway 50 is provided with a rectangular air-intake port 55 which is positioned in the vicinity of root portion 28*a* of the rear face of the guiding wall 28.

More specifically, the upstream end portion 51 of the intake passageway 50 is positioned in the vicinity of the bottom of the main housing 12, and the air-intake port 55 orientated inward (approximately vertically) is positioned at a region of the fan cover 27 which is close to the upstream end portion 51. Therefore, the air which is sucked from the air-intake port 55 can be introduced, via the intake passageway 50 and a flexible bellows 36 which is disposed at a lower left portion of the rear end portion 12B of the main housing 12, into an air cleaner chamber 31 formed inside the air cleaner 30. The air thus introduced into the air cleaner chamber 31 is forced to pass through the filter member 32 so as to remove the dust included therein before the air is permitted to enter the carburetor chamber 34. Thereafter, the air thus treated is permitted to pass through the carburetor 35, the connecting tube 38 and the intake port 22 and to enter the internal combustion engine 20.

According to the chain saw 10 of this embodiment which is constructed as described above, the external air that has been introduced into the main housing 12 by means of the cooling fan 25 can be guided so as to flow concentratedly toward the cylinder 21 where cooling is most needed by the effect of the guiding wall 28 formed on the fan cover 27, the air being subsequently employed for cooling the cylinder 21 and then discharged through a discharger port (not shown) formed in the main housing 12 toward the external atmosphere. Part of the air introduced into the main housing 12 is permitted to enter the internal combustion engine 20 through the intake passageway 50, the air cleaner 30, the carburetor chamber 34 and the carburetor 35.

In this case, even if large quantities of dust are present in the air that has been sucked into the main housing 12 by means of the cooling fan 25, since this air mixed with dust can be concentratedly sprayed against the cylinder 21 by the effect of the guiding wall 28, most of the dust can be prevented from flowing down to the vicinity of the root portion 28*a* of the rear face of guiding wall 28 (a region where the fan cover 27 is disposed) which constitutes a shadow zone for the air flow. Therefore, the air that will be introduced into the air cleaner 30 after being sucked from the air-intake port 55 positioned in the vicinity of root portion 28*a* of the rear face of the guiding wall 28 will be almost free from any dust.

Therefore, accordingly to the chain saw 10 of this embodiment, since it is constructed such that a guiding wall 28 is formed on the fan cover 27 and an air-intake port 55 is positioned in the vicinity of root portion 28*a* of the rear face of the guiding wall 28, the performance thereof to cool the internal combustion engine 20 can be effectively enhanced and, the clogging of the air cleaner 30 of the air intake system of internal combustion engine 20 due to the dust in the sucked air can be minimized, thus making usual cleaning of the air cleaner 30 unnecessary.

Although one embodiment of the present invention has been explained in the foregoing description, it should be understood that the present invention is not limited to these embodiments, but can be varied without departing from the spirit and scope of the invention set forth in the accompanying claims.

For example, in the foregoing embodiment, the explanation thereof is directed to the case where the present invention is applied to a chain saw. However, the present invention is also applicable, other than the chain saw, to various kinds of portable power working machines such as an engine cutter, hedge trimmer, etc.

As apparent from above explanation, according to the portable working machine of the present invention, it is possible to effectively improve the performance thereof to cool the internal combustion engine mounted thereon as a power source for driving the working components thereof, and also possible to prevent, in a most possible manner, an air cleaner of the air intake system of a small air-cooled internal combustion engine from being clogged with dust, thus making usual cleaning of the air cleaner unnecessary.

What is claimed is:

1. A portable power working machine comprising:

a main housing;

an air-cooled internal combustion engine received in the main housing with a cylinder thereof being horizontally disposed and a head portion of the cylinder being orientated rearward;

a cooling fan which is adapted to be driven by the internal combustion engine and disposed on one side of the main housing;

a guiding wall disposed on one side of the main housing and at a location rear to the cooling fan and projected inward therefrom for guiding cooling air toward the cylinder;

an intake passageway formed at the location rear to the cooling fan for introducing air into an air-intake system of the internal combustion engine; and an air-intake port for the intake passageway, the air-intake port being positioned in the vicinity of a root portion of a rear face of the guiding wall.

2. The portable power working machine according to claim 1, wherein the guiding wall is formed on a fan cover which is disposed inner than an outer cover of the main housing.

3. The portable power working machine according to claim 2, wherein the intake passageway is constituted by the outer cover and the fan cover, and the air-intake port is formed in the fan cover.

4. The portable power working machine according to claim 1, wherein an upstream end portion of the intake passageway is positioned in the vicinity of bottom of the main housing, and the air-intake port is formed in the vicinity of the upstream end portion of the intake passageway to communicate with the intake passageway.

5. The portable power working machine according to claim 1, wherein the air entering from the air-intake port is enabled to enter into a carburetor through the intake passageway and an air cleaner.

6. The portable power working machine according to claim 5, wherein the air cleaner is formed of a cap-like configuration and detachably secured to a rear end portion of the main housing with a filter member being interposed therebetween as a partitioning wall, thereby enabling the air cleaner to communicate through the filter member with the carburetor.

7. The portable power working machine according to claim 1, wherein said portable power working machine is a chain saw which is provided, as a working member, with a saw chain set composed of a saw chain and a guide bar and disposed on the other side of the main housing which is opposite to the one side.

* * * * *